United States Patent [19]

Seymour

[11] Patent Number: 4,994,145

[45] Date of Patent: Feb. 19, 1991

[54] PROCESS FOR PRODUCING A CONSTANT DISTRIBUTION OF A SELECTED PROPERTY ACROSS THE WIDTH OF PULP MAT ON A PULP WASHING SURFACE

[76] Inventor: George W. Seymour, 2841 Parkwood Dr., Brunswick, Ga. 31520

[21] Appl. No.: 318,118

[22] Filed: Mar. 2, 1989

[51] Int. Cl.[5] ..... D21C 9/00; D21C 9/06

[52] U.S. Cl. ..... 162/49; 162/60; 162/61

[58] Field of Search ..... 162/60, 198, 263, 252, 162/253, DIG. 10, DIG. 11, 49, 61, 259

[56] References Cited

U.S. PATENT DOCUMENTS

| | | | |
|---|---|---|---|
| 3,914,585 | 10/1975 | Wilhelm, Jr. et al. | 162/DIG. 11 |
| 3,936,665 | 2/1976 | Donoghue | 162/DIG. 11 |
| 3,989,085 | 11/1976 | Crosby | 162/250 |
| 4,046,621 | 9/1977 | Sexton | 162/40 |
| 4,096,028 | 6/1978 | Rosenberger | 162/49 |
| 4,205,541 | 6/1980 | Zucker | 162/60 |
| 4,207,141 | 6/1980 | Seymour | 162/49 |
| 4,662,991 | 5/1987 | Karna | 162/49 |
| 4,732,651 | 3/1988 | Lisnyansky | 162/60 X |
| 4,735,684 | 4/1988 | Seymour | 162/49 |
| 4,840,204 | 6/1989 | Seymour | 162/49 |

FOREIGN PATENT DOCUMENTS 1203407 4/1986 Canada .

OTHER PUBLICATIONS

Perkins, J. K., "Brown Stock Washing Using Rotary Filters", pp. 1-17, 19-23, 25-31, 33-37, 39-43, 45-51, 53-55, Tappi Press (undated).

Sande, W. E., et al., Tappi Journal, Mar. 1988, pp. 93-97.

Tappi Journal, Feb. 1988, p. 199 and opposite side.

*Primary Examiner*—Steve Alvo

[57] ABSTRACT

In a pulp washing system where there is substantially constant average weight of pulp mat (on a dry pulp basis), washing uniformity is improved by controlling the weight per unit area of liquid alone or liquid and pulp combined in the pulp mat across its width to obtain a substantially constant distribution of selected property in the pulp mat across its width. This is accomplished by steps comprising determining the property in a plurality of selected locations across the width of the pulp mat and also the average value of the property across the width and controlling dilution liquid input into the headbox in response to the determination to produce of substantially constant distribution of the property across the width of the mat.

23 Claims, 2 Drawing Sheets

PROCESS FOR PRODUCING A CONSTANT DISTRIBUTION OF A SELECTED PROPERTY ACROSS THE WIDTH OF PULP MAT ON A PULP WASHING SURFACE

TECHNICAL FIELD

The present invention is directed to controlling to obtain more uniform washing results in a cellulosic washing process.

BACKGROUND OF THE INVENTION

My copending application Ser. No. 07/170,299, now U.S. Pat. No. 4,840,704 is directed to controlling filtrate recirculation to obtain a substantially constant average mass of pulp mat on a pulp washing surface. However the distribution of recirculated filtrate is not controlled. This wouldn't matter if the amount of pulp and water across the width of the washing surface were uniform and if the formed pulp mat were dried uniformly but this is not the case because in current practice recirculated filtrate is distributed by a header with slots and baffles which do not accommodate to change in tonnage rates and because in current practice there is inefficient mixing in a cross direction in the headbox and because the apertured drying surface can become clogged in parts.

It is an object herein in one embodiment to control distribution of dilution liquid to obtain more uniform washing operation by the showers that are applied.

It is an object herein in other embodiments to obtain more uniform distribution of one or more of various properties in the pulp mat, e.g., mass of pulp and water, mass of water, dilution factor, displacement factor, dielectric loss, concentration of sulfur and/or sodium.

SUMMARY OF THE INVENTION

In the pulp washing process herein a cellulosic pulp slurry stream and dilution liquid are continuously introduced to form a level of admixture of these comprising pulp and liquid in a container wherefrom a mat comprising pulp and liquid continuously forms on a washing surface which is moved at a surface speed. Wash liquid is directed at the mat on the washing surface and vacuum filtering is carried out to produce a product stream on said surface and a filtrate which is divided so that part of it is recirculated to provide dilution liquid feed.

The process is carried out to obtain a substantially constant percentage of pulp in said admixture and a substantially constant average weight of liquid in the pulp mat per unit area on the washing surface despite change of production rate. A preferred method for obtaining this result is taught in my copending application Ser. No. 07/170,299 filed Mar. 21, 1988 and now U.S. Pat. No. 4,840,704 and generally comprises the steps of (1) measuring to determine the total mass of said product stream per unit area on the washing surface and controlling the surface speed thereof in response to said determination to obtain a selected value for said total mass, and (2) controlling the rate of dilution liquid introduction in response to a level sensor in said container to obtain a selected level of said admixture in said container.

The improvement of the invention herein comprises controlling the weight per unit area of liquid alone or liquid and pulp combined in said mat across its width to obtain a substantially constant distribution of selected property in the pulp mat across its width by steps comprising (a) determining said property in a plurality of selected locations across the width of said mat and also the average value of said property across the width of said mat, and (b) controlling liquid input into said container in response to said determining to produce a substantially constant distribution of said property across the width of said mat.

The property determined in step (a) can be, for example, mass of liquid in the mat per unit area, mass of pulp and liquid in the mat per unit area, dilution factor, displacement factor, dielectric loss in the mat or concentration of chemicals in the mat (e.g., sulfur or sodium).

Apparatus used in making the determination depends on what property is being determined and preferably is means for measuring capacitance or means for measuring backscattered nuclear radiation or means for measuring conductivity, or means for measuring X-ray fluorescence. Preferably a single apparatus is utilized which is reciprocated or traversed across the width of the mat to make a plurality of measurements and produce a plurality of output signals each corresponding to one of said selected locations.

The dilution liquid input controlled in step (b) preferably constitutes only a portion of the dilution liquid introduced to form the level of admixture comprising pulp and liquid in the container, and the rest is introduced into the container through a conventional header. Said dilution liquid input controlled in step (b) is preferably introduced into the container through a plurality of aligned valved conduits (e.g., 4 to 15 conduits) spaced along the cross direction of the headbox where each conduit is positioned to discharge at a location corresponding to a different one of said plurality of selected locations.

Preferably, the discharge from each conduit is controlled by controlling the valve therein in response to an error signal correlated to a deviation from said average value of property as determined for the one of the selected locations to which the location of the discharge of the conduit corresponds, and the error signal is generated based on comparison of a signal correlated to said property as determined for the one of the selected locations to which the location for the discharge of the conduit corresponds and an average signal determined by averaging all of said signals correlated to said property as determined for each of said plurality of selected locations.

Preferably the container includes a headbox which contains a body of admixture comprising pulp and liquid and each conduit discharges into said body below an upper surface thereof at a location in a corresponding transverse position to that of the one of the plurality of selected locations for which the error signal is generated for that conduit.

Preferably, the discharge from each conduit is in the direction of a mixing paddle which rotates in the machine direction to provide mixing and flow substantially only in the machine direction and to minimize mixing in the cross direction, and the flow in the machine direction from said paddle is toward the transverse position or location of the one of the plurality of selected locations in response to determination for which flow from the conduit discharge at the paddle is controlled.

The cellulosic pulp slurry stream herein can be, for example, brown stock or effluent from a bleaching stage.

The pulp washing surface herein can be the surface of a vacuum filter washer drum or a continuous screen wire (apertured) belt. The systems where the process herein can be utilized include, for example, vacuum filter washer drum systems as described hereinafter or a Fourdrinier type washer where an apertured belt washing surface is gravity fed by a headbox. The method herein can be utilized in any or all stages of a multi-stage system, e.g., in more than one pulp washer in a series of these.

The terms "corresponding transverse position" and "corresponding transverse location" are used herein to mean in a substantially common plane perpendicular to the axis of rotation where a vacuum filter drum is used and in a substantially common plane perpendicular to the plane of travel where the pulp mat is moved horizontally.

The term "machine direction" is used herein to mean the general direction of flow from the input end of the machine to the output end of the machine.

The term "cross direction" is that transverse to the machine direction.

The term "dilution factor" is used herein to mean $(A-T)/P+1$ where A is the flow rate of liquid introduction into the washing system, T is the total mass flow rate and P is the pulp flow rate on a dry basis.

The term "displacement factor" is used herein to mean $1.0-(C_m-C_s)/C_h$ wherein $C_m$ is the concentration of a material in the discharged mat, $C_s$ is the concentration of said material in the showers, and $C_h$ is the concentration of said material in the admixture in the headbox.

BRIEF DESCRIPTION OF THE DRAWINGS

The foregoing objects, features, and advantages of the invention will be more fully understood upon consideration of the following detailed description of preferred embodiments of the invention, together with the accompanying

DETAILED DESCRIPTION OF THE INVENTION

Figure 1:
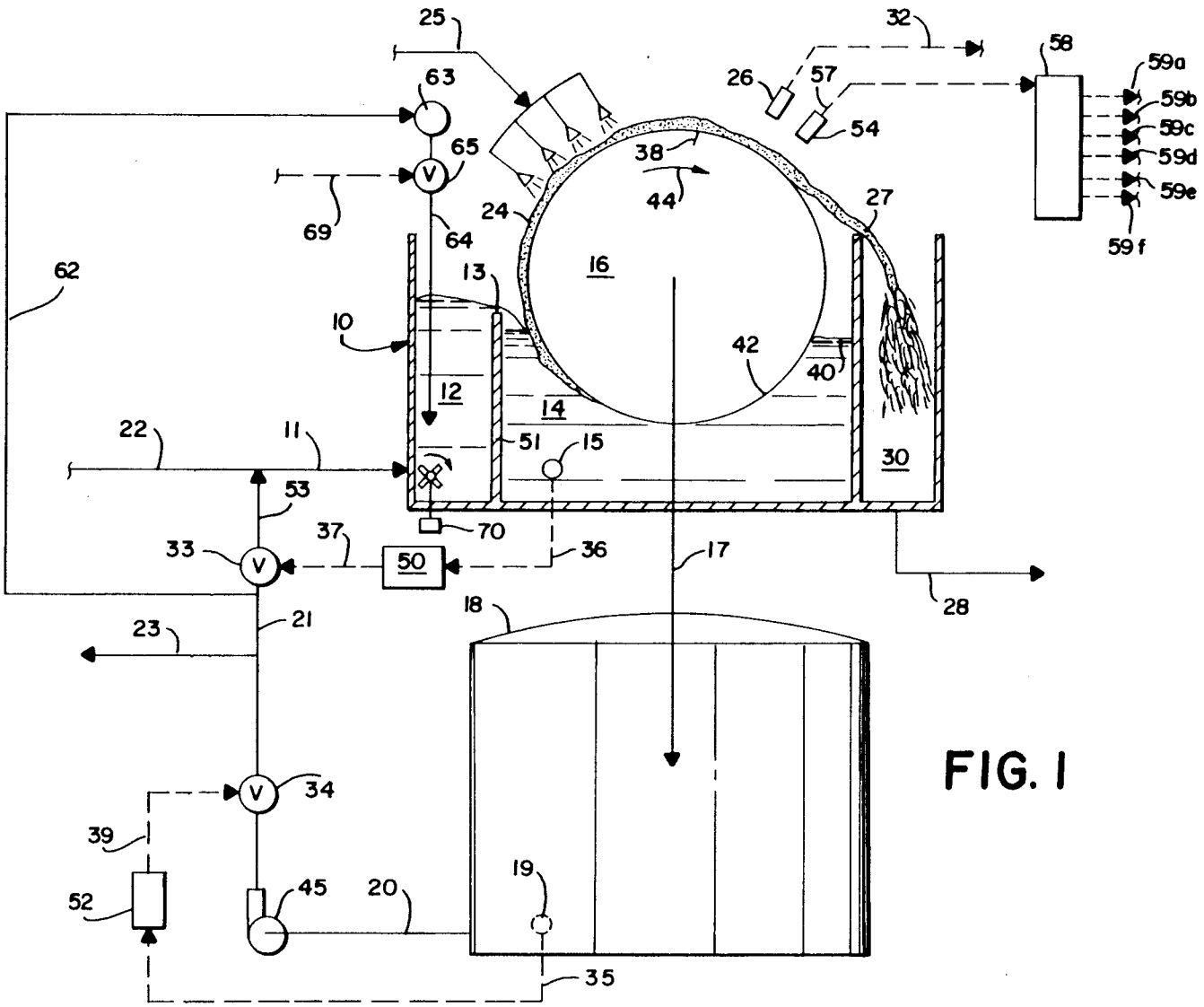
FIG. 1 is flow schematic of the application of the invention in respect to one stage of a multistage drum type washer system.

Before proceeding with description of the drawings, it is noted that the drawing of FIG. 1 is directed to one stage in a process for countercurrent washing of brown stock normally relying on two or three vacuum filter washer drums in series. Such a system is depicted in FIG. 1 of Seymour U.S. Pat. No 4,207,141 and is described therein at column 4, line 65 to column 6, line 2 and this depiction and description is incorporated herein by reference. As indicated above, this system is only exemplary of those with which the process herein finds application. It is further noted that the drawing of FIG. 1 is directed to a system utilizing the method described in my copending application Ser. No. 07/170,299, now U.S. Pat. No. 4,840,704.

We turn now to the embodiment of FIG. 1. With continuing reference to the drawing of FIG. 1, pulp and liquid brown stock from pulp digesters (not shown) containing black liquid contaminant to be removed by washing is routed via a transfer line 22 and is admixed with vat dilution liquid entering via line 53 and the combination of contaminated pulp and liquid is routed by a feed line 11 into a headbox 12 of a drum washer system 10, where it is admixed with further vat dilution liquid entering via lines 64 (depicted as conduits or downlegs 64*a*, 64*b*, 64*c*, 64*e* and 64*f* in FIG.. 2) to form an admixture of contaminated pulp and liquid. Said admixture builds up in headbox 12 and overflows a baffle 51 as indicated by reference numeral 13 into washer vat 14 to form a body of feed admixture therein whose upper surface is denoted by reference numeral 40. A vacuum filter drum 16 having an apertured wire surface 42 has its lower portion protruding into the body of feed admixture in washer vat 14 and rotates in the direction shown by arrow 44 and application of vacuum from the interior of drum 16 through apertures in wire surface 42 causes a mat of pulp 24 to form on surface 42 that contains 80–90% liquid and 10–20% pulp and causes some of the liquid in said body of feed admixture to enter the interior of drum 16. A wash liquid spray from a liquid sprayer 25 directs shower liquid onto the pulp mat 24 passing thereunder and displaces the more contaminated liquid that was retained in the mat 24 as formed on surface 42. A more pure mat in the form of a product stream 27 is fed into a discharge means 30, e.g., in the form of a screw conveyor, and is discharged as indicated by the arrow designated by reference numeral 28 to a next stage of washing or a next operation. Liquid displaced from mat 24 by the shower spray plus the volume of shower liquid in excess of the amount required to constitute the liquid in product stream 27 is drawn by the vacuum of drum 16 through apertures in wire 42 into the interior of drum 16. The liquid entering the interior of drum 16 which is designated filtrate or filtrate liquid is discharged therefrom via downleg 17 into filtrate tank 18 and forms a body of filtrate liquid (not shown) therein. An outlet line 20 from tank 18 is equipped with a pump 45 and a valve 34 whereby the filtrate is removed from tank 18. Line 20 branches into a line 23 which routes part of the filtrate in line 20 to the previous washing stage shower (wash sprayer) or another operation and the line 21 which branches into lines 53 and 62. Line 53 contains a valve 33 and recirculates part of the dilution liquid from part of the filtrate for admixture with brown stock feed entering via line 22 as indicated previously. Line 62 recirculates a second part of the dilution liquid from part of the filtrate by feeding the same to a trim header 63 (See FIG. 2) which in turn feed the conduits 64 (64*a*, 64*b*, 64*c*, 64*d*, 64*e*, and 64*f*) which feed said dilution liquid into headbox 12 as indicated previously. The conduits 64 are equally spaced and are aligned over the cross direction of headbox 12 and have outlets below the upper surface of admixture in headbox 12. The conduits 64 each contain a valve 65 (conduit 64*a* contains valve 65*a*, conduit 64*b* contains valve 65*b*, etc.; see FIG. 2). The lines 53 and 62 are sized so that about 15 to 25% of the recirculated filtrate enters line 62 and the remainder of the recirculated filtrate is routed via line 53 so that about 15 to 25%, say 20% of dilution liquid feed enters headbox 12 through conduits 64, and the rest of the dilution liquid feed enters headbox 12 through line 11.

The rate of shower liquid (wash liquid) input is determined by means not shown, i.e., by the method of Seymour U.S. Pat. No. 4,207,141 or other wash liquid input control system.

The filtrate tank 18 contains a level sensor 19 (e.g., of the pressure sensing type) which senses the level of filtrate in tank 18 and sends a signal via a signal line 35 to a controller 52 which is set with a set point correlated to a selected level and signals valve 84 via a signal line 39 to actuate valve 34 to a more open or closed position to automatically adjust the flow through line 20 to maintain the selected level in tank 18. This filtrate tank level control system is of a conventional type.

A measuring means schematically designated by reference numeral 26 is located to operate on the pulp mat on wire 42 downstream of a vacuum break 38 and before discharge from the screen surface 42, i.e., to operate on the product stream (which is composed of cleaner pulp than in the feed and liquid), to enable determination of total mass in said product stream per unit area of surface 42 at the location where measuring is carried out.

The measuring means 26 is preferably a backscattered nuclear radiation gauge that is used to determine total mass of product stream per unit area on the wire 42. Suitable apparatus is readily available commercially from NDC Systems of Monrovia, Calif. or the Ohmart Corporation of Cincinnati, Ohio.

The measuring means 26 can also be apparatus for measuring capacitance across the pulp mat thereunder which is sensitive primarily to the water in the pulp mat product which is 80–90% water. With this type of system capacitance measurement is converted to a weight of liquid per unit area by multiplication by a scaling factor and the weight of liquid per unit area is converted to weight of total product per unit area by utilizing an assigned consistency (e.g., determined by measuring the same in the product stream or estimated). Capacitance measurements to determine weight of liquid per unit area in a pulp mat are disclosed in Seymour U.S. Pat. No. 4,207,141.

The measuring means 26 can also be apparatus for measuring the thickness of the pulp mat thereunder, i.e., the level of the top surface of the mat above wire 42. Such apparatus can rely on mechanical measurements carried out, for example, utilizing a mechanical lever arm attached to a ski shaped means which rides on the top surface of the pulp mat. Such apparatus can also instead rely on sound or electromagnetic waves where such waves are projected from a generator toward the pulp mat and measurement of reflected waves is correlated to thickness. When thickness measuring means is utilized, total mass per unit area at the location measured is readily determined by multiplying the measured thickness by a specific gravity for the mat which is derived, for example, from measurements or estimation.

The measuring means 26 includes means to send a signal correlated to total mass of the pulp mat product stream per unit area of wire 42 via a signal line 32 to a controller (not shown) which automatically controls means (not shown) to vary the speed of the rotation of drum 16, e.g., an adjustable motor. The controller set point is set at a selected total mass so that it causes the speed of rotation of drum 16 to increase when the determined total mass is above the selected value and so that it causes the speed of rotation of drum 16 to decrease when the determined total mass is below the selected value thereby to automatically control the total mass per unit area of pulp mat on wire 42 in the measured area to obtain and maintain the selected total mass value.

While various measuring means 26 are non-linear in respect to measurement of total mass per unit area on wire 42, controlling to obtain a selected valve correlated to the total mass eliminates error which would be attributed to said nonlinearity.

The washer vat 14 contains a level sensor 15, for example of the pressure sensing type, for sensing the level of diluted pulp slurry in vat 14. The level sensor 15 sends a signal correlated to the level sensed via a signal line 36 to a controller 50 which is set with a set point correlated to a selected level and signals valve 33 via a signal line 37 to automatically adjust valve 83 to control the dilution water input via line 21 to control the level of diluted pulp slurry in vat 14 to the selected value set whereby a desired consistency of, for example 1¼% to 1½%, may be obtained and maintained in the diluted pulp slurry in vat 14.

The method as described in conjunction with FIG. 1 thus far provides a substantially constant consistency in vat 14 and mat 24 and a substantially constant average weight of liquid in the pulp mat per unit area on the wire 42. Following is described details of the invention herein comprising controlling the weight per unit area of liquid alone or liquid and pulp combined in the pulp mat across its width to obtain a substantially constant distribution of selected property in the pulp mat across its width. This enables uniform washing across the face of the washing surface with a uniform shower flow across said washing surface.

A measuring means schematically designated by reference 54 is located to operate on the pulp mat on wire 42 downstream of a vacuum break 38 and before discharge from the surface of wire 42 (which is composed of cleaner pulp than in the feed), to enable the determination of step (a), i.e., determining the property (for which a substantially constant distribution is sought across the width of the mat) in a plurality of selected locations across the width of the mat.

Said property can be, for example, mass of pulp and liquid in the mat (i.e., total mass in the product stream) per unit area of surface 42 at the location where measuring is carried out, mass of liquid in the mat per unit area of surface 42 at the location where measuring is carried out, dilution factor, displacement factor, dielectric loss, concentration of chemical (e.g., sulfur or sodium), amount of radiation backscatter, capacitance, conductivity, or of characteristic X-rays emitted in response to excitation by radiation from an isotopic source (i.e., X-ray fluorescence). What measuring means 54 is selected depends on the particular property determined.

When the property being determined is total mass in the mat, the measuring means can be the same as the measuring means 26 and desirably a single apparatus is utilized to perform the functions of both measuring means 26 and measuring means 54 and signal relating to the average value of the property determined as described below is routed to the controller (not shown) which automatically controls means (not shown) to vary the rotating of drum 16. Thus, the measuring means 54 for use in determining total mass can be a backscattered nuclear radiation gauge, apparatus for measuring capacitance across the pulp mat thereunder or apparatus for measuring the thickness of the pulp mat thereunder as particularly described in respect for measuring means 26. The determination of the total mass with each of these types of measuring means is carried out the same way as determination of total mass is described above in connection with measuring means 26.

Where the property being determined is mass of liquid in the mat per unit area of surface 42, the measuring means 54 can be, for example, apparatus for measuring capacitance, a backscattered nuclear radiation gauge or pulp mat thickness measuring means as described above. When capacitance measuring apparatus is utilized, capacitance measurement is converted to weight of liquid per unit area by application of a scaling factor. When a backscattered nuclear radiation gauge is utilized, mass of liquid per unit area is determined from total mass per unit area as measured by utilizing the dry pulp flow rate as measured at the inlet to the washing process and the drum area and speed or with an assigned consistency (e.g., determined by measuring the same in the product stream or estimated). When thickness measuring means is utilized, the mass of liquid in weight per unit area at a location measured is determined by multiplying the measured thickness by a specific gravity of the mat (derived from measurement or estimation) and an assigned consistency (derived from measurement or estimation). Here as when total mass is being determined, a single measuring apparatus can be utilized for means 26 and means 54 but the average signal sent to the means for controlling drum speed should be converted to represent total mass.

When the property being measured is dilution factor, the measuring means 54 is preferably means for measuring the conductivity of the pulp mat.

When the property being measured is displacement factor, the measuring means 54 is preferably means for measuring the conductivity of the pulp mat.

When the property being measured is dielectric loss, means 54 is preferably means for measuring the conductivity of the pulp mat.

When the property being measured is concentration of a chemical such as sulfur or sodium, the measuring means is preferably means for measuring conductivity coupled with establishing data correlating conductivity to concentration. An X-ray fluorescence analyzer can also be used for this purpose especially where the property being measured is concentration of sulfur; such analyzers rely on radiation from a radioactive source to excite the substance being measured to emit distinctive X-rays which are analyzed. Such analyzers are available from Princeton Gamma-Tech, Inc. of Princeton, N.J.

As is evident, when the property being measured is amount of backscattered nuclear radiation, a backscattered nuclear radiation gauge is utilized; when the property being measured is capacitance, a capacitance measuring means is utilized; when the property being measured is conductivity, a conductivity measuring means is utilized; and when the property being measured is X-ray fluorescence, an X-ray fluorescence measuring means (e.g., an X-ray fluorescence analyzer) is utilized.

As is evident, the measurements by means 54 within the scope of the invention herein do not have to be calibrated to produce absolute values of the property being measured, since relative values at the selected locations are what is necessary to provide control to produce the substantially constant distribution across the width of the mat which is being sought.

Figure 3:
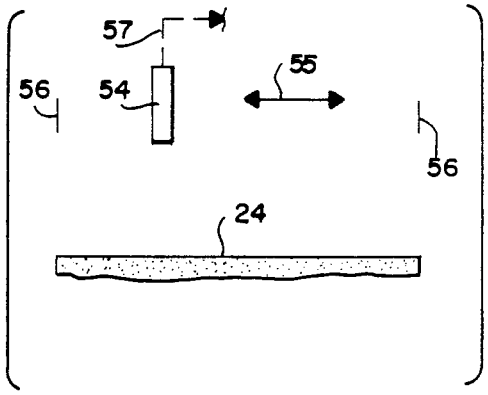
FIG. 3 is a schematic depicting traversing of measuring means across the width of a pulp mat to provide input for controlling of the valves in the valved conduits of FIG. 2.

As depicted in FIG. 1, a single apparatus is utilized to obtain measurements in respect to the plurality of selected locations. This is done by utilizing a traversing means in combination with the measuring means 54 to reciprocate the means 54 as depicted in FIG. 3 back and forth across mat 24 as indicated by double arrow 55, e.g., over the width of the web as depicted by limit lines 56. A suitable traversing means is depicted in FIG. 3 of Seymour U.S. Pat. No. 4,207,141 and is described therein at column 8, lines 5–22, and this depiction and description is incorporated herein by reference.

When a single apparatus 54 is used in conjunction with traversing means, the apparatus 54 is activated at periodic intervals to provide readings at the selected locations by means not shown, e.g., timing means, e.g., a chain making one revolution for the time required to traverse between successive selected locations with gears thereon to open and close the circuit of a signal line 57 from the measuring means 54. Where the measuring means is one which is to contact the mat, e.g., a conductivity measuring means, it is appropriately traversed across the mat on a ski shaped means which rides on the top surface of the pulp mat.

While a single apparatus 54 is depicted in FIGS. 1 and 3, it should be realized that a plurality of such could be utilized, one for each of the selected locations. In the event this alternative is utilized, traversing means are not utilized.

Figure 4:
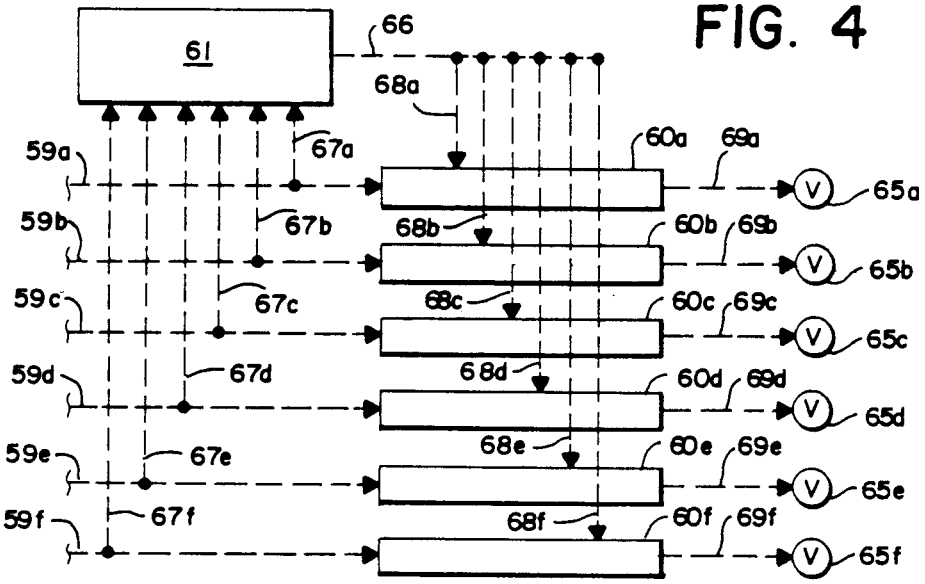
FIG. 4 is a schematic depicting a control system for the system of FIG. 1.

The measuring means 54 includes means to send a signal correlated to the property being determined via the signal line 57 to a distributor 58 (FIG. 1) which distributes the signal to the appropriate signal line 59 (lines 59*a*, 59*b*, 59*c*, 59*d*, 59*e* and 59*f* are depicted in FIGS. 1 and 4), i.e., to the signal line 59 leading to means for controlling the conduit 64 corresponding to the measured location corresponding to the signal.

Turning now to FIG. 4, the signal lines 59*a*, 59*b*, 59*c*, 59*d*, 59*e*, and 59*f* transmit signals respectively to comparators 60*a*, 60*b*, 60*c*, 60*d*, 60*e* and 60*f*. All the signal lines 59*a*, 59*b*, 59*c*, 59*d*, 59*e*, and 59*f* also transmit signals via respective signal lines 67*a*, 67*b*, 67*c*, 67*d*, 67*e* and 67*f* to an averager 61 which averages the signals to provide an output signal via a signal line 66 corresponding to the average of the determinations for all the selected locations. The signal line 66 transmits said output signal, i.e., the average signal, to each of the comparators 60*a*, 60*b*, 60*c*, 60*d*, 60*e* and 60*f* via respective signal lines 68*a*, 68*b*, 68*c*, 68*d*, 68*e* and 68*f*. The comparators 60*a*, 60*b*, 60*c*, 60*d*, 60*e* and 60*f* compare the input signals respectively received via signal lines 59*a*, 59*b*, 59*c*, 59*d*, 59*e* and 59*f* and the average signal respectively received via signal lines 68*a*, 68*b*, 68*c*, 68*d*, 68*e* and 68*f* and provide respective output error signals (each corresponding to the deviation between an input signal corresponding to property determined at a selected location received via a line 59 and the average signal) to respective output signal lines 69*a*, 69*b*, 69*c*, 69*d*, 69*e* and 69*f* collectively denoted 69 and these transmit respective output error signals to valve controllers (not shown) in the respective valves 65*a*, 65*b*, 65*c*, 65*d*, 65*e* and 65*f* (see FIGS. 2 and 4). Each valve controller functions in response to the error signal it receives to partly open or close its associated valve 65 in correlation to the signal it receives.

We turn now to the correlation between controlling a valve 65 and the property being determined for which constant distribution of the property across the width of the pulp mat is sought. If the property determined is total mass in pulp mat, and the determination for a location indicates the total mass is low for that location compared to the average value across the width of the mat, then the valve controller associated with the appropriate valve 65 causes that valve to move toward the closed position (i.e., reduces the liquid flow through the corresponding conduit 64) to provide more pulp in the mat in the corresponding transverse position (since there is less liquid to displace pulp). On the other hand, When a determination indicates the total mass is high for a location compared to the average value, the valve controller on the appropriate valve 65 causes it to move to a more open position to increase the flow of liquid through the corresponding conduit 64. If the property determined in the pulp mat is mass of liquid, and the determination for a location indicates the mass of liquid is low for a location compared to the average value, then the valve controller on the appropriate valve 65 causes it to move to a more closed position to decrease the flow of liquid through the corresponding conduit 64 creating a thicker mat at that position and therefore more liquid, and if the mass of liquid is high, then the valve controller on the appropriate valve 65 causes it to move to a more open position to increase the flow of liquid through the corresponding conduit 64. If the property determined in the pulp mat is dilution factor, and the determination for a location indicates the dilution factor is low compared to the average value over the width of the mat, then the valve controller on the appropriate valve 65 causes it to move toward a more open position while if the dilution factor is indicated to be high, then the valve controller on the appropriate valve 65 causes it to move to a more closed position. If the property determined in the pulp mat is displacement factor and the determination for a location indicates the displacement factor is low compared to the average across the width, then the valve controller on the appropriate valve 65 causes it to move to a more open position to increase the liquid flow through the corresponding conduit 64 while if the displacement factor is determined to be high for a location, then the valve controller on the appropriate valve 65 causes it to move to a more closed position. When the property determined in the pulp mat is dielectric loss and determination for a location indicates the dielectric loss is low compared to the average across the width of the mat, then the valve controller on the appropriate valve 65 causes it to move to a more closed position thereby reducing liquid flow through the corresponding conduit 64 and when determination for a location indicates dielectric loss is high compared to the average across the width of the mat, then the valve controller on the appropriate valve 65 causes it to move to a more open position thereby increasing liquid flow through the corresponding conduit 64. When the property determined is concentration of a substance and determination for a location indicates the concentration is high compared to the average over the width of the mat, then the valve controller on the appropriate valve 65 causes it to move to a more open position thereby increasing flow from the corresponding conduit 65 (thereby displacing pulp to provide a thinner sheet for better washing) while if determination indicates the concentration is low, the valve controller on the appropriate valve 65 causes it to move toward a more closed position thereby reducing flow from the corresponding conduit 64. When the property determined is amount of backscattered nuclear radiation and this is determined to be high at a location compared to the average across the mat, then the valve controller on the appropriate valve 65 causes it to move to a more open position thereby increasing flow from the corresponding conduit 64, while if said property is determined to be low at a location compared to the average across the mat, then the valve controller on the appropriate valve 65 causes it to move to a more closed position thereby decreasing flow from the corresponding conduit 64. When the property being determined is capacitance, and this is determined to be high for a location compared to the average across the width of the mat, then the valve controller on the appropriate valve 65 causes it to move toward a more open position thereby increasing flow of liquid through the corresponding conduit 64 while if this is determined to be low compared to the average across the width of the mat, then the valve controller on the appropriate valve 65 causes it to move to a more closed position. When the property being determined is conductivity and this is determined to be high for a location compared to the average across the width of the mat, then the valve controller on the appropriate valve 65 causes it to move toward a more open position thereby increasing flow of liquid from the corresponding conduit 64, while if this is determined to be low for a location compared to the average across the width of the mat, then the valve controller on the appropriate valve 65 causes it to move toward a more closed position. When the property being determined is amount of characteristic X-rays emitted as a result of excitation in response to radiation from a radioactive source, i.e., X-ray fluorescence and determination for a location indicates this is high compared to the average value over the width of the mat, then the valve controller on the appropriate valve 65 causes it to move to a more open position while if determination indicates this is low, then the valve controller on the appropriate valve causes it to move toward a more closed position.

Control based on the above correlation in accordance with the invention herein provides a substantially constant distribution of determined property across the width of the pulp mat. It is noted that a perfectly level weight of dry pulp across the width of a pulp washer is not the goal herein as it is in a paper machine profile control system. The major accomplishment rather is to control dilution liquid distribution to give a more uniform washing system.

It is noted there is no change in total flow in line 21 despite increase in flow via line 62 since the flow through valve 33 would be decreased by the controller 50.

In the determination of the dilution factor or the displacement factor, estimated values can be used for the parameters that are essentially the same across the width of the washer surface such as liquor concentration in the vat, liquor concentration in the showers, dry pulp flow rate, and the shower flow per unit area of the drum at all positions, without altering the relative values that are determined and then used in the control of valves 65.

In cases where only one instrument is traversed across the width of the washing surface, the instrument readings can be used directly in determining the control action to be taken with valves 65 without converting the readings to any named parameter such as mass, conductivity, liquid content, chemical concentration etc., since only relative values are important in this control action. Multiplication, division, etc. of these instrument readings by constants to reach a given dimensioned parameter actually has no effect upon the relative values so derived and the result is the same as if just the raw reading had been used to begin with. This is true for all instruments that are directly measuring some interaction between an emanated electromagnetic radiation and the pulp mat or some constituent of the pulp mat, and is also true for instruments that are reacting to the thickness of the pulp mat such as sound waves, or a levered ski type arrangement. Thus in step (a), determining said property in a plurality of selected locations across the width of said mat can consist of obtaining measurements on interactions with the mat or on the mat for each of said selected locations without relating the measurements to property different from what is directly measured. Care must be taken however to be sure that the parameter being monitored by the instrument is properly correlated with the proper direction of the valve position change as previously given.

In regulating the valves 65, control would not be effected once one of them were wide open or totally closed. So that this is not a factor, means are preferably included to reduce all the valve settings by ten percent when any one of them is wide open and to increase all valve positions by ten percent when any one of them is totally closed; in the case of such reduction or increase, the valve 33 will automatically adjust the total dilution to match vat level and the total flow via line 21 will remain unchanged.

Furthermore, in accordance with good control system practice, it is preferable to reduce the correction carried out (opening or closing of a valve 65) to 64% of that determined or signaled to prevent cycling.

Figure 2:
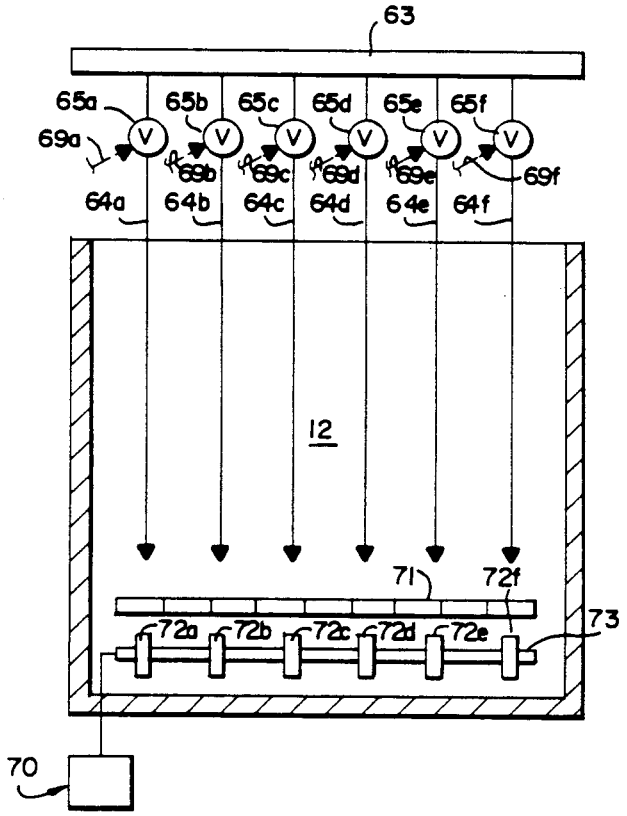
FIG. 2 is a schematic vertical sectional view depicting valved conduits for allocating dilution liquid input in the cross direction and mixing means associated therewith for the system depicted in FIG. 1.

Turning now to FIG. 2, the effluents from the conduits 64*a*, 64*b*, 64*c*, 64*d*, 64*e* and 64*f* are discharged into headbox 12 toward a mixer 70 where said effluent is admixed with the combination entering headbox 12 from line 11 via a header 71. The mixer is a paddle mixer comprising a plurality equally spaced sets of radially extending paddles 72*a*, 72*b*, 72*c*, 72*d*, 72*e*, and 72*f*, rotating on a common shaft 73 which extends in a cross direction. The paddles 72*a*, 72*b*, 72*c*, 72*d*, 72*e* and 72*f* are in a corresponding transverse position respectively to the discharges from conduits 64*a*, 64*b*, 64*c*, 64*d*, 64*e*, and 64*f* and have their wide surface extending in a cross direction. This enables mixing by the paddles of the various effluents in a machine direction, i.e., so that cross mixing between the flows from the the conduits is minimized. A ribbon mixer of the type normally employed in a headbox does not serve this function. The admixtures formed at the various paddles do not substantially intermingle and pass over baffle 51 in generally laminar flow condition in essence as separate streams which do not lose their identity and are picked up by drum 16 while maintaining transverse position so that the flow from each conduit is maintained in the corresponding transverse position to that of the location on the mat measured to provide control regulating said flow.

Dashed lines are used on the drawings to connote signal lines. The arrows on signal lines indicate the direction of signal transmission.

The arrows on solid lines on the drawings schematically representing pipes or conduits indicate the direction of liquid flow through such pipes and conduits.

Variations will be evident to those skilled in the art. Therefore, the scope of the invention is intended to be defined by the claims.

What is claimed is:

1. In a pulp washing process where a cellulosic pulp slurry stream and a dilution liquid are continuously introduced into a headbox from which an admixture of these overflows into a vat to form a level of admixture comprising pulp and liquid in said vat wherein a mat comprising pulp and liquid continuously forms on a washing surface which is moved at a surface speed and wherein wash liquid is directed at said mat on said washing surface and vacuum filtering is carried out to produce a product stream of washed pulp and liquid at a downstream location on said surface and a filtrate which is divided so that part of it is recirculated to provide said dilution liquid and where there is obtained a substantially constant percentage of pulp in said admixture and a substantially constant average weight of liquid in the pulp mat per unit area of the washing surface despite change of production rate, the improvement comprising controlling the weight per unit area of liquid alone or liquid and pulp combined in said mat across its width to obtain a substantially constant distribution of a selected property in the pulp mat across its width by steps comprising:

(a) determining said property in a plurality of selected locations across the width of said mat and also the average value of said property across the width of said mat, and (b) controlling a plurality of dilution liquid inputs into said headbox, each of said dilution liquid inputs being positioned to discharge at a location corresponding to a different one of said plurality of selected locations and each of said dilution liquid inputs being controlled in response to said determining to produce a substantially constant distribution of said property across the width of said mat.

2. The process of claim 1, wherein the dilution liquid inputs controlled in step (b) constitute a portion of said dilution liquid continuously introduced into said headbox.

3. The process of claim 2, wherein said dilution liquid inputs are discharged into said headbox through a plurality of conduit means where each conduit means contains a valve means and discharge from a conduit means is controlled by controlling the valve means therein in response to an error signal correlated to a deviation from said average value of property determined for the corresponding selected location.

4. The process of claim 3, wherein the valve means on each conduit means is controlled in response to an error signal generated based on comparison of a signal correlated to said property as determined for the one of the selected locations to which the location for the discharge of the conduit means corresponds and an average signal determined by averaging all the signals correlated to said property as determined for each of said plurality of selected locations.

5. The process of claim 4, wherein the headbox contains a body of admixture having an upper surface and wherein each conduit means discharges into said body below said upper surface at a location in a corresponding transverse position to that of the one of the plurality of selected locations for which said error signal is generated for that conduit means.

6. The process of claim 5, wherein discharge from each conduit means is mixed with admixture in said body so that mixing is substantially only in a machine direction.

7. The process of claim 6 wherein said mixing is carried out by utilizing a paddle mixer comprising a plurality of paddle means each having an axis of rotation extending in the cross direction and being associated with the discharge from a different one of the conduit means.

8. The process of claim 7 wherein the determining of step (a) comprises reciprocating measuring means across the width of said mat to obtain measurements related to said property at each of said plurality of selected locations.

9. The process of claim 1 wherein in step (a), determining said property in a plurality of selected locations across the width of said mat comprises measuring capacitance in the mat at each of said selected locations.

10. The process of claim 1 wherein in step (a), determining said property in a plurality of selected locations across the width of said mat comprises measuring backscattered nuclear radiation for each of said selected locations.

11. The process of claim 1 wherein in step (a), determining said property in a plurality of selected locations across the width of said mat comprises measuring conductivity in the mat for each of said selected locations.

12. The process of claim 1 wherein the step (a) determining said property in a plurality of selected locations across the width of said mat comprises measuring X-ray fluorescence for each of said selected locations.

13. The property of claim 1 wherein in step (a) determining said property in a plurality of selected locations across the width of the mat consists of obtaining measurements of interaction with the mat or obtaining measurements on the mat for each of said selected locations without relating the measurements to property different from what is directly measured.

14. The process of claim 1 wherein the property determined in step (a) is mass of the liquid in the mat.

15. The process of claim 1 wherein the property determined in step (a) is mass of pulp and liquid in the mat.

16. The process of claim 1 wherein the property determined in step (a) is dilution factor.

17. The process of claim 1 wherein the property determined in step (a) is displacement factor.

18. The process of claim 1 wherein the property determined in step (a) is dielectric loss.

19. The process of claim 1 wherein the property determined in step (a) is concentration of substance selected from the group consisting of sulfur and sodium.

20. The process of claim 1 wherein the property determined in step (a) is amount of backscattered radiation.

21. The process of claim 1 wherein the property determined in step (a) is capacitance.

22. The process of claim 1 wherein property determined in step (a) is conductance.

23. The process of claim 1 wherein the property determined in step (a) is X-ray fluorescence.

* * * * *